United States Patent [19]

Helbig et al.

[11] 4,412,273

[45] Oct. 25, 1983

[54] HALOGEN INCANDESCENT LAMP WITH PART METAL, PART PLASTIC SOCKET, PARTICULARLY FOR AUTOMOTIVE HEADLIGHTS

[75] Inventors: Peter Helbig, Sontheim; Walter Schönherr, Giengen-Hürben; Hermann Steiner, Herbrechtingen, all of Fed. Rep. of Germany

[73] Assignee: Patent-Treuhand-Gesellschaft für Elektrische Glühlampen mbH, Munich, Fed. Rep. of Germany

[21] Appl. No.: 453,491

[22] Filed: Dec. 27, 1982

[30] Foreign Application Priority Data

Jan. 22, 1982 [DE] Fed. Rep. of Germany ... 8201536[U]

[51] Int. Cl.[3] ..... F21M 3/30

[52] U.S. Cl. ..... 362/211; 313/113; 362/267; 362/296; 362/308; 362/310; 362/362; 362/375

[58] Field of Search ..... 313/113, 316, 318, 322; 362/267, 296, 308, 310, 211, 362, 375

[56] References Cited

U.S. PATENT DOCUMENTS 4,261,027 4/1981 Chapman et al. ..... 362/255

4,319,156 3/1982 Bienvenue et al. ..... 362/267

*Primary Examiner*—Stephen J. Lechert, Jr.

*Assistant Examiner*—Joel P. Okamoto

*Attorney, Agent, or Firm*—Frishauf, Holtz, Goodman & Woodward

[57] ABSTRACT

To permit introduction of a halogen incandescent lamp into a reflector, in sealed relationship thereto, a plastic end portion (*2c*) of the base (2) of the lamp is secured to a metal sleeve, for example of steel, which is telescopically connected to an adjustment cap (*2a*) in which the bulb (1) is seated. After adjustment of the position of the bulb, so that the filaments will emit light in a predetermined pattern with respect to the base, the adjustment cap and the sleeve are welded together. The plastic portion includes a groove (9) in which a sealing ring (10) for example of silicone rubber is placed, the plastic element including therebeyond a positioning or seating flange (11). The plastic end portion, thus, can readily be assembled with a glass reflector, the sealing ring (10) providing for a moisture tight seal against, for example, a glass reflector.

5 Claims, 3 Drawing Figures

HALOGEN INCANDESCENT LAMP WITH PART METAL, PART PLASTIC SOCKET, PARTICULARLY FOR AUTOMOTIVE HEADLIGHTS

The present invention relates to a halogen incandescent lamp, particularly adapted for assembly with a reflector in an automotive headlamp, and having a socket which is made partly of metal and partly of plastic.

BACKGROUND

The incandescent lamp has, for example, two filaments, one filament for "high beam" and the other one for "depressed beam" or "low beam" projection. The lamp bulb is made of high temperature resistant glass, for example quartz glass, or hard glass, and filled with an inert gas which has a halogen additive.

THE INVENTION

In accordance with a feature of the invention, the socket comprises a cylindrical positioning sleeve made of metal which fits into a cylindrical socket sleeve, likewise made of metal, and welded thereto, for example after positioning the lamp in a predetermined location with respect to a plastic ring-shaped terminal part secured to the cylindrical socket sleeve. The diameter of the adjustment sleeve and other socket sleeve are so matched to each other that the adjustment sleeve is securely seated in the socket sleeve, but adjustable therewith prior to adjustment of the dimension with respect to the extending, dish-like plastic element, the adjustment sleeve and socket sleeve are then welded together. The adjustment sleeve has a central opening to receive the single ended press steel of the lamp bulb, for example with electrical offset with respect to the axis of the socket.

The ring-shaped or dish-shaped plastic element is formed with a circumferential groove to receive a sealing ring, ahead of a seating flange, in order to permit fitting the plastic element into a reflector. The plastic element, preferably, terminates in a frusto-conical end portion from which connecting tabs project.

The arrangement has the advantage that the contact between the lamp and a reflector which, for example, may be of an unyielding material is effected by the plastic element, so that slight yielding is possible; yet, the high heat generated by the lamp bulb itself is not directly transmitted to the plastic element which might cause weakening or deformation thereof. Further, the connecting tabs, or connecting prongs project from a plastic element so that insulation thereof with respect to each other, as well as with respect to a headlight assembly is simple, and connection by a further plastic connector is readily possible without danger of breakage if the connection should not be made by perfect in-line engagement of the elements.

DRAWING

Figure 1:
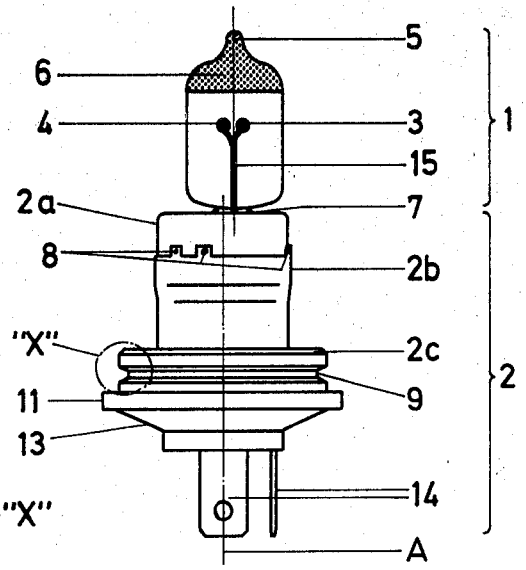
Figure 1A:
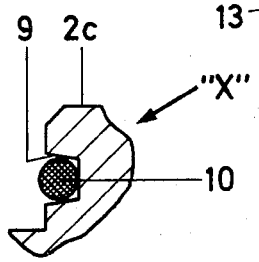
Figure 2:
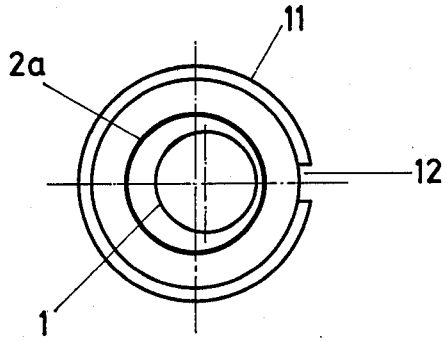

FIG. 1 is a side view, partly schematic, of the lamp in the socket;

FIG. 1A is a fragmentary sectional view through the portion circled "X" in FIG. 1; and FIG. 2 is a top view of the lamp A halogen incandescent lamp 1 is assembled to lamp socket 2—see FIG. 1. The lamp bulb is made of high melting glass, such as quartz glass, or hard glass, and filled with an inert gas with halogen additive. Two separately switchable filaments 3, 4, of tungsten are located within the lamp. The lamp 1 is formed, at its top, with an exhaust tip 5, and with a shielding coating 6. The other end of the lamp bulb—not shown in the drawings—is sealed shut with a press seal, as well known in the lamp manufacturing field.

The lamp socket 2, in accordance with a feature of the invention, has a cylindrical adjustment cap or sleeve **2*a* made of metal, for example argentan, or German silver; or of superrefined steel; it is assembled to a socket sleeve 2*b*, also made of metal, for example argentan or superrefined steel. The socket sleeve 2*b* is assembled with a dish, or disc element 2*c*** made of plastic. Thermosetting, as well as thermoplastics are suitable.

The lamp 1 is retained within the adjustment sleeve **2*a* in accordance with any suitable and well-known construction by retaining the lamp press within a fitted opening 7 in the adjustment sleeve 2*a*. Adjustment sleeve 2*a*, preferably, is cup-shaped, formed with an upper wall, formed with the aperture 7, into which the press of the bulb 1 extends. The opening 7 is laterally offset with respect to the axis A of the socket. This lateral offset, for example, places one of the filaments, for example filament 4 essentially in line with the socket axis A, to provide for high beam light projection, whereas the other lamp filament 3 is offset from the axis, to provide for "low beam" projection, when the lamp is assembled in a reflector. The lamp is fitted into the adjustment sleeve or holder 2*a*, to be retained therein in a predetermined position. Precise adjustment of the filaments of the lamp with respect to the remainder of the socket is obtained by fitting the adjustment sleeve, or cap 2*a* and the socket sleeve 2*b*, telescopingly, within each other, and positioning the adjustment sleeve or cap 2*a* as desired, for example under control of an automatic positioning element, responding to light emitted from one of the filaments for precise location of the lamp with respect to the socket. The diameters of the cap 2*a* and of the socket sleeve 2*b* are matched to each other to provide for a secure and reliable engagement. Welding tabs 8 are formed on the socket sleeve 2*b*, circumferentially distributed over the socket sleeve, for welding the socket sleeve 2*b* and the cap 2*a*** together, after adjustment of the lamp bulb.

A plastic, laterally projecting dish- or ring-shaped element **2*c* is provided, receiving the socket sleeve 2*b*. The maximum diameter of the ring is substantially greater than that of the socket sleeve 2*b*. A circumferential groove 9 is formed in the plastic ring 2*c*. A sealing ring 10, for example made of silicone rubber—see FIG. 2—is fitted within the groove 9**, to seal the lamp against the reflector, for example within a reflector structure which, additionally, has a front lens to provide an entirely completely sealed construction.

The plastic base **2*c* is formed with a laterally extending ring flange 11. Ring flange 11 is formed with a notch, or groove 12 at one position—see Fig. 3—in order to provide a locating depression upon assembly of the lamp into a reflector; additionally, the notch or groove 12 prevents relative rotation of the socket, and hence the lamp with respect to a reflector. The dish-shaped plastic element 2*c* terminates in a frusto-conical end portion 13 to which contact tabs or flat prongs 14 are secured, electrically connected to the electrical connecting leads 15 (FIG. 1**) of the lamp bulb.

To assemble the lamp to a reflector structure—not shown, and of any suitable construction—it is merely necessary to snap the plastic element, with the sealing ring 10 therein, into a suitable opening of a reflector, for example of glass, thereby securely sealing the lamp and the reflector into a sealed structure.

A suitable plastic for the element *2c* is polyamide reinforced by glass fibers, especially the polyamide known under the trade name Ultramid.

Usually, the section of a lamp base which for the optimal sealing of the headlamp interior is matched as closely as possible to the shape of the reflector neck section associated therewith, is made of metal. When plastic material is used for this base section, the desired matching of the shapes can be obtained with still greater precision, and a more efficient sealing is achieved in conjunction with the sealing ring.

The use of plastic as a base material permits manufacture at lower cost. The element is injection molded from the plastic material.

We claim:

1. Single-ended press-sealed halogen cycle incandescent lamp, particularly for use in automotive headlights and for combination with a reflector, having a lamp bulb (1);

a lamp base (2) receiving said lamp bulb;

and terminal connectors (14) projecting from the lamp, wherein, in accordance with the invention, the lamp base comprises a generally cup-adjustment cap (*2a*) having a cylindrical portion, and made of metal;

a cylindrical sleeve (*2b*) made of metal and telescopically connected to the cylindrical portion of the adjustment cap;

and a plastic terminal element (*2c*) secured to the cylindrical sleeve, the adjustment cap being formed with an opening (7) receiving the bulb (1), the diameters of the cylindrical portion and of said sleeve being matched to each other to provide for a snug fit between the sleeve and said cylindrical portion;

integrally formed welding flaps distributed about the circumference of the cylindrical portion and secured to one of said sleeves, and weld connections between said cylindrical portion and said sleeve at said welding flaps to provide for reliable secure welded connection of the cylindrical portion of the adjustment cap and the sleeve;

the plastic end portion (*2c*) comprising a ring-shaped element having an outer diameter substantially greater than the outer diameter of the cylindrical sleeve, secured to the cylindrical sleeve, and formed with a circumferential groove (9);

a sealing ring (10) received within the circumferential groove;

and an annular projecting flange (11) located beyond the sealing ring, at the site of the groove remote from the lamp, and terminating in a frusto-conical portion (13);

and wherein the connecting prongs (14) are secured to the frusto-conical portion and electrically connected to the bulb.

2. Lamp according to claim 1 wherein the opening (7) in the adjustment cap has a central plane which is laterally offset with respect to the axis (A) of the base (2);

and wherein the lamp includes more than one filament, located at respective sides of the center axis of the lamp, one of said filaments being positioned at least approximately in line with the axis of the base.

3. Lamp according to claim 1 wherein the lamp is a multifilament lamp;

and wherein the axis of the lamp is laterally offset with respect to the axis (A) of the base.

4. Lamp according to claim 1 wherein the adjustment cap (*2a*) and said sleeve (*2b*) comprise at least one of: argentan; highly refined steel.

5. Lamp according to claim 3 wherein the adjustment cap (*2a*) and said sleeve (*2b*) comprise at least one of: argentan; highly refined steel.

* * * * *